United States Patent [19]

Carpenter

[11] 4,306,395

[45] Dec. 22, 1981

[54] LIGHTWEIGHT CEMENTITIOUS PRODUCT AND METHOD FOR MAKING SAME

[76] Inventor: Orval R. Carpenter, Rt. 2, Box 58-10, Afton, Okla. 74331

[21] Appl. No.: 82,473

[22] Filed: Oct. 9, 1979

Related U.S. Application Data

[63] Continuation-in-part of Ser. No. 911,449, Jun. 1, 1978, abandoned.

[51] Int. Cl.[3] ..... B28B 23/00; B28B 23/04

[52] U.S. Cl. ..... 52/223 R; 52/309.12; 264/45.1; 264/51; 264/228; 264/DIG. 7; 428/327; 428/402; 428/407; 428/312.4; 428/313.5; 428/319.1; 428/446

[58] Field of Search ..... 264/115, 122, 228, 333, 264/DIG. 7, 45.1, 51; 52/612, 659, 223 R, 309.12; 428/310 HC, 327, 402, 407

[56] References Cited

U.S. PATENT DOCUMENTS

| | | | |
|---|---|---|---|
| 3,247,294 | 4/1966 | Sabouni | 52/612 X |
| 3,338,848 | 8/1967 | Hamilton | 264/DIG. 7 |
| 3,492,384 | 1/1970 | Motthews | 264/87 X |
| 3,697,366 | 10/1972 | Harlock | 264/DIG. 7 |
| 3,867,503 | 2/1975 | Shoe | 264/228 X |
| 3,974,024 | 8/1976 | Yano | 264/87 X |
| 4,100,242 | 7/1978 | Leach | 264/115 |

OTHER PUBLICATIONS

The Chemistry of Cement & Concrete, F. M. Lea, Edward Arnold (Publishers) Ltd., London, 1956, pp. 339–340.

*Primary Examiner*—Thomas P. Pavelko
*Attorney, Agent, or Firm*—Dunlap, Codding & McCarthy

[57] ABSTRACT

An improved lightweight cementitious product consisting essentially of an aqueous cementitious mixture and reclaimed polystyrene beads in which the reclaimed polystyrene beads are bonded to the cementitious material. The cementitious product is prepared by dispensing reclaimed polystyrene beads in an aqueous cementitious mixture, such as hydraulic cement and water, to form a resulting mixture, placing the resulting mixture in a mold, and compressing the resulting mixture in the mold until setting of the resulting composition occurs. The volume of the resulting mixture in the mold is reduced during compression by approximately fifteen percent of the original volume and substantially no water is exuded from the resulting mixture during compression. The reclaimed polystyrene beads are substantially spherical in configuration and have a particle size substantially larger than "virgin" polystyrene beads.

41 Claims, 7 Drawing Figures

LIGHTWEIGHT CEMENTITIOUS PRODUCT AND METHOD FOR MAKING SAME

REFERENCE TO RELATED APPLICATIONS

This application is a continuation-in-part application of my copending patent application U.S. Ser. No. 911,449 filed June 1, 1978, now abandoned, and entitled "Lightweight Concrete Product and Method for Making Same".

BACKGROUND OF THE INVENTION

This invention relates generally to the field of producing lightweight cementitious compositions and products formed therefrom.

The methods of preparing lightweight cementitious materials, such as lightweight concrete, heretofore available have not been entirely satisfactory for the reason that all of the methods known to the inventor require the addition of various constituents to achieve a strong but lightweight concrete mass that has a high homogeneity of constituents and which is uniformly bonded throughout the mass. There have been several patents issued relating to lightweight concrete using expanded polystyrene beads and the like, but all of the previous methods simply added an amount of compressible aggregate to conventional concrete mixtures, and have usually utilized expandable polystyrene beads that are expanded by various heating methods either before the beads are introduced into the concrete mixture, or expanded after they have been added to the concrete mixture.

It has been necessary in the past to coat the polystyrene beads after they have been expanded with some type of bonding agent in order to uniformly disperse the lightweight beads when admixed into heavy cementitious material. An example of such a method is taught in U.S. Pat. No. 3,764,357 issued to Bowles and Parsons. This patent teaches the wetting of the surfaces of the lightweight aggregate particles with an aqueous medium and admixing the wet aggregate particles with dry, finely divided cementitious material to form a coating about the particles before adding the particles to the concrete mix. U.S. Pat. No. 3,869,295 issued to the same individuals teaches the preparation of expanded polystyrene beads by expanding same in hot water for the purpose of reportedly attaining increased strength.

U.S. Pat. No. 3,214,393 issued to Sefton teaches a light-weight concrete material that is comprised of cement, a primary aggregate, expanded styrene polymer, a specific homogenizing agent consisting of polyvinyl alcohol, a bituminous compound, and an alkali metal salt. Another prior art composition is found in U.S. Pat. No. 3,021,291 issued to Thiessen, which teaches a cellular concrete product that reportedly has superior resistance to impregnation by water and vapor. The Thiessen patent teaches a mixture containing a polymeric material which will expand under the influence of heat during the curing to sufficiently fill the voids in the concrete, the polymeric material having an expanding agent incorporated therein.

SUMMARY OF INVENTION

A principle object of the present invention is to provide a cementitious composition that yields a strong yet lightweight mass from which building panels are formed.

Another object of the present invention while achieving the above stated object is to provide a lightweight cementitious composition comprised of compressible aggregate dispersed in a cementitious mixture that yields a uniformly bonded mass that is achieved without the use of any bonding agent to precoat the compressible aggregate.

Yet another object of the present invention while achieving the above stated objects is to provide a lightweight concrete composition that achieves a homogeneous distribution of the compressible aggregate in the mixture without the utilization of a dispersing agent or the like.

Other objects of the present invention are to provide building panels and the like made from the composition and method of molding disclosed herein and which have various predetermined configurations and structural integrities.

Further objects, features and advantages of the present invention will appear as the description proceeds.

To the accomplishment of the above and related objects this invention may be embodied in the form illustrated in the accompanying drawings, attention being called to the fact, however, that the drawings are illustrative only and that changes may be made in the specific construction illustrated and described within the scope of the appended claims.

According to the present invention an improved lightweight cementitious product is provided, the material consisting essentially of a cementitious composition and an effective minor amount of reclaimed polystyrene beads.

Further, according to the invention a method for producing an improved lightweight cementitious is provided which comprises forming an aqueous cementitious mixture, such as hydraulic cement and water, admixing an effective minor amount of reclaimed polystyrene beads into the cementitious mixture to form a resulting mixture, placing the resulting mixture in a mold, compressing the resulting mixture in the mold, maintaining comprising on the resulting admixture until setting of the compressed resulting mixture occurs, and thereafter removing the lightweight cementitious product from the mold.

DESCRIPTION OF THE INVENTION

Figure 1:
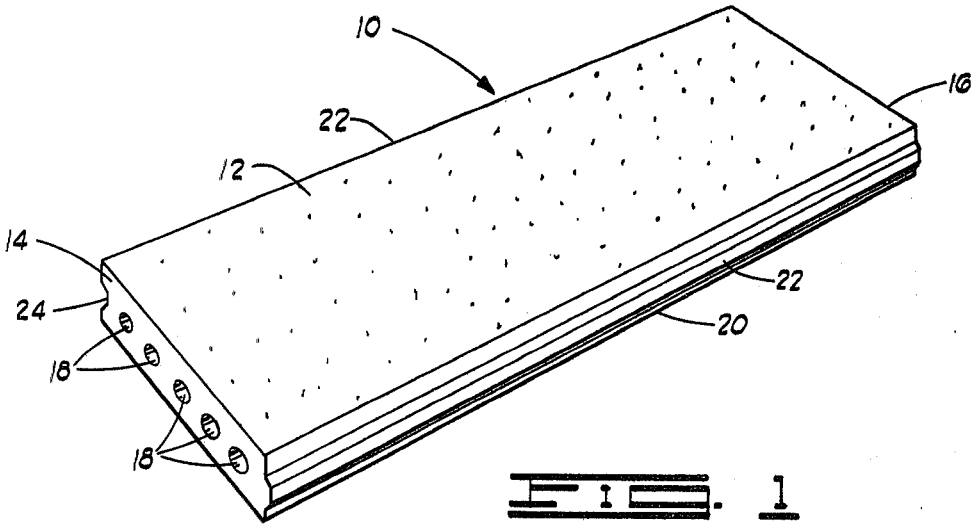
FIG. 1 is an isometric view of a novel building panel constructed of the lightweight cementitious material of the present invention and formed by the method herein presented.

Referring now to the drawings, the reference numeral 10 represents a building panel of a preferred construction made in accordance with the method to be described hereinbelow. The building panel 10 is an elongated member having a body 12 that has opposite ends 14 and 16. Extending through the body 12 are a plurality of conduit shaped bores 18 that extend from the end 14 completely through the body 12 communicating with the end 16. While the bores 18 serve to lessen the weight of the building panel 10, the bores 18 also serve to provide channels through which electrical wires and plumbing pipes can pass. Thus, a building made from a plurality of panels like the building panel 10 can be remodeled at any time, since new wires and pipes can be disposed as desired through the bores 18. Such is not possible with conventional solid building panels.

The body 12 of the building panel 10 has a first side edge 20 which has a rib 22 extensive therefrom and extending from the end 14 to the end 16. The body 12 also has a second side edge 22 which has a groove 24 extending from the end 14 to the end 16. The profile of the groove 24 is designed to receive a rib 22 from another building panel 10 positioned adjacent to and contacting the building panel 10 shown in FIG. 1. The rib 22 and the groove 24 provide means of interlocking adjacent building panels when used in constructing a wall, roof or the like.

Figure 2:
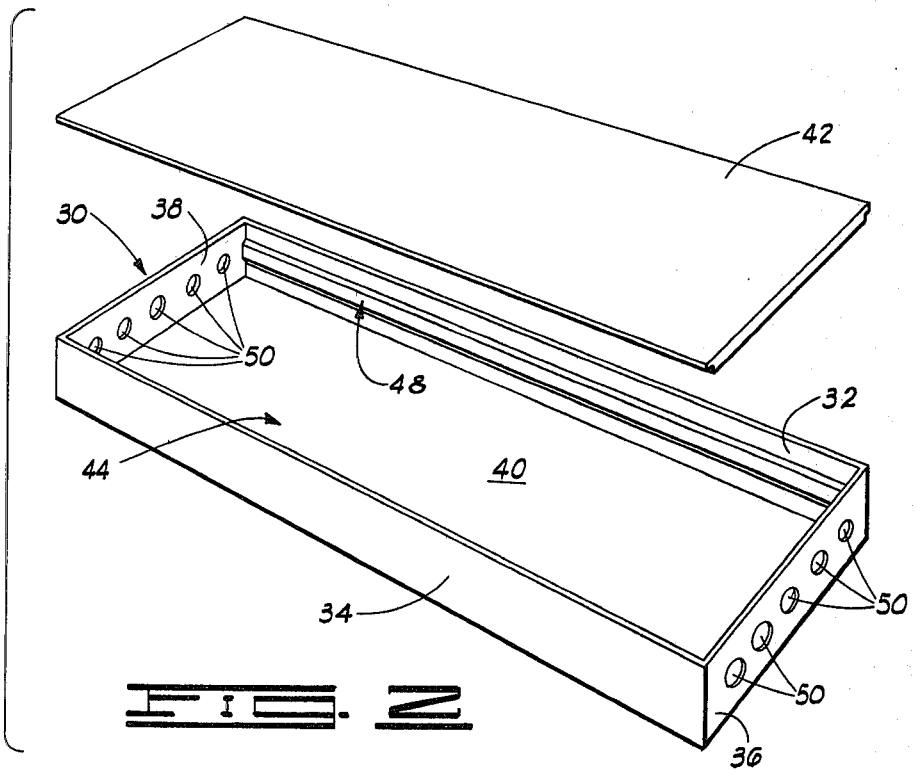
FIG. 2 is an exploded view of a mold of the type utilized to form the building panel shown in FIG. 1.

The building panel 10 is formed in the mold 30 shown in FIG. 2. The mold 30 is generally a rectangularly shaped box having a first side 32, a second side 34, a first end 36, a second end 38, a bottom 40 and a removable top panel 42. When the top panel 42 is positioned to enclose the interior of the mold 30, the interior of the mold 30 forms a cavity 44 conforming to the external configuration of the building panel 10. A groove 46 is disposed in the second side 34 for the purpose of forming the rib 22 along the first side edge 20 of the building panel 10, and a rib 48 extends from the first side 32 to form the groove 24 in the building panel 10. The first and second ends 36, 38 have a plurality of apertures 50 disposed to receive a plurality of tubes for a purpose to be made clear below, each of such tubes extendable through and supported by corresponding axially aligned bores in the first and second ends 36 and 38.

Figure 3:
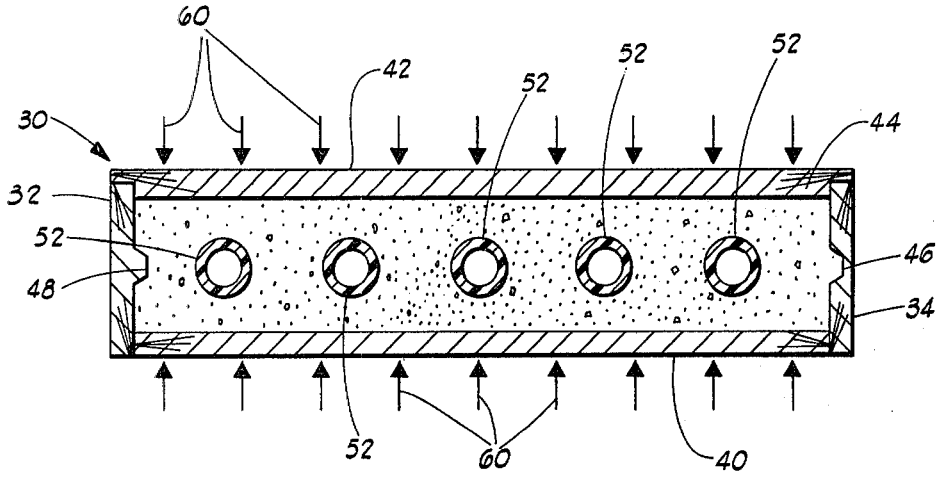
FIG. 3 is a cross section of the mold of FIG. 2 as filled to form the building panel shown in FIG. 1.

In making the building panel 10, a cementitious composition consisting essentially of water, a cement-like material and reclaimed polystyrene beads is placed into the cavity 44 of the mold 30 after tubes (not shown in FIG. 2) are placed through the apertures 50 in the first and second ends 36, 38. FIG. 3 is a cross sectional view of the mold 30 having tubular members 52 shown as extending through the cavity 44.

As previously stated, the cementitious composition employed to produce the lightweight cementitious product of the present invention consists essentially of water, the cement-like material and reclaimed polystyrene beads. The amount of each of the constituents employed in the cementitious composition can vary widely and will be dependent, to a large degree, upon the density and weight characteristics sought in the cementitious product produced, as well as the use for which the product is employed. The reclaimed polystyrene beads function as compressible aggregate in the cementitious composition. Thus, the amount of the reclaimed polystyrene beads employed in the cementitious composition, as well as the amounts of water and cement-like material, will readily be known, or can be determined, by those skilled in the art.

As used in the present disclosure, the term "cement-like material" is to be understood to include any aqueous based material which is initially a slurry and upon curing produces a solid, substantially homogenous product. Typical of such cement-like materials are the hydraulic cements, such as Portland cement, masonery cement, alumina cement, magnesium cement and the like; and, gypsum, such as calcium hemihydrate, insoluble anhydrite, and the like.

The term "masonry cement" as used herein is to be understood to mean a special group of cements for use in mortars for masonry construction. Such masonry cements are more workable and more plastic than Portland cement. Masonry cement may be similar to waterproofed Portland cement while other types of masonry cement comprise Portland cement mixed with hydrated lime, crushed limestone, diatomaceous earth or granulated slag. Further, as used herein and as accepted in the construction and cement trade, the term masonry cement represents a separate and distinct class of cements from the term Portland cement as used herein.

Figure 6:
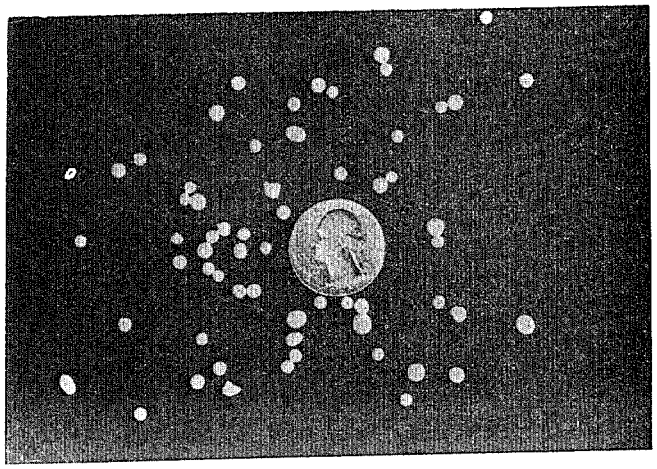
FIG. 6 is a photographic reproduction illustrating the relative size and the configuration of virgin polystyrene beads, the virgin polystyrene beads depicted are hereinafter defined as the compressible aggregate No. 3.

The term "virgin polystyrene beads" as used in the disclosure is to be understood to mean polystyrene particles which have initially been expanded to form an expanded bead having a rigid, closed cell cellular plastic structure. The expansion of the polystyrene particles can typically be accomplished by subjecting the particles, at atmospheric pressure, to hot air, hot water, radiant heat, or steam. At pressures below atmospheric (vacuum) the expansion of the polystyrene particles can be achieved by convection heating techniques. The "virgin polystyrene beads" include both the modified polystyrene beads, (the polystyrene beads which are substantially fireproof) and the unmodified polystyrene beads (the polystyrene beads which are flammable). The "virgin polystyrene beads" typically have a density of from about 1.0 pcf to about 4.0 pcf. Such "virgin polystyrene beads" are available as DYLITE virgin beads from ARCO/Polymers, Inc., a subsidiary of Atlantic-Richfield Company, Philadelphia, Pa. A photographic reproduction of modified "virgin polystyrene beads" is set forth in FIG. 6.

Figure 7:
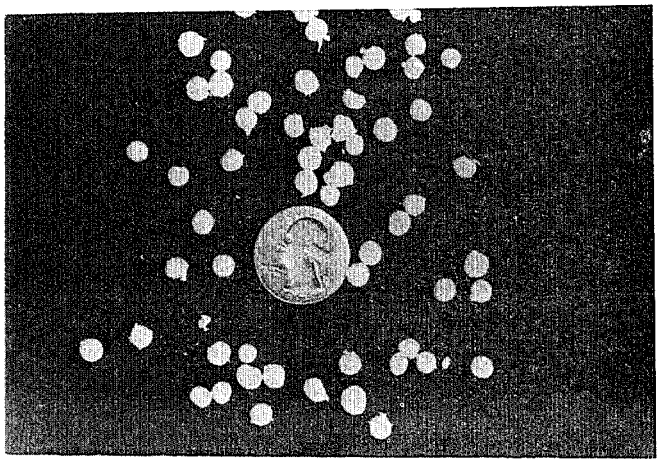
FIG. 7 is a photographic reproduction illustrating the relative size and substantially spherical configuration of reclaimed polystyrene beads, the reclaimed polystyrene beads depicted are hereinafter defined as the compressible aggregate No. 1.

The term "reclaimed polystyrene beads" as used in the present disclosure is to be understood to mean polystyrene beads obtained by subjecting a polystyrene material formed of "virgin polystyrene beads" to a mechanical force, such as a hammermill, to produce "reclaimed polystyrene beads" in which at least major portion, (typically at least about 80 percent) have a generally spherical configuration. A photographic reproduction depicting "reclaimed polystyrene beads" obtained by subjecting pieces of a polystyrene foam to the action of a hammermill is set forth in FIG. 7. It should be noted from a comparison of FIGS. 6 and 7 that the size of the "reclaimed polystyrene beads" are substantially larger in size than the "virgin polystyrene beads". The mechanism which results in the increased size of the reclaimed polystyrene beads is not known. Such may be the result of the processing of the "virgin polystyrene beads" to form the polystyrene product, or the action of the hammermill on the polystyrene product to produce the "reclaimed polystyrene beads".

An excellent source of cured polystyrene material for use in practicing the present invention is the waste product currently now available at locations using polystyrene, such as at a styrofoam block manufacturing facility. Using such waste product to construct building panels or the like by the present invention will help eliminate one source of pollution in this country; and furthermore, such usage will convert what is now a waste product into energy saving building materials having superior thermal insulating characteristics.

Use of the term "reclaimed polystyrene beads", as set forth in the method described hereinafter, eliminates the need for coating the reclaimed polystyrene beads with a bonding agent of any kind prior to their incorporation into the cementitious material. Further, as shown in the example, the virgin polystyrene beads which are initially expanded beads will not provide a material having the properties of the material of the present invention. In addition, no dispersing agent is required to maintain a homogeneous distribution of the reclaimed polystyrene beads in the cementitious mixture. The simple mixing action of a portable paddle type mortar mixer is sufficient to distribute the reclaimed polystyrene beads throughout the cementitious material.

A typical method of producing polystyrene block from which the reclaimed polystyrene beads can be obtained is as follows. Expandable polystyrene beads or particles are initially expanded to produce the "virgin polystyrene beads" heretofore defined using any of the before mentioned expansion techniques. The initially expanded beads, e.g., the virgin polystyrene beads, are screened to remove lumps or agglomerates. The screened virgin polystyrene beads are thereafter generally aged for a period of time of from about six to about twenty-four hours to minimize shrinkage, collapse and molding variation in the virgin polystyrene beads. The aged virgin polystyrene beads are then charged to a mold, such as a preheated mold. The top lid of the mold is positioned and secured. Steam (5–20 psig) in one or two stages (low pressure steam followed by high pressure steam) is fed into the mold. Air and condensate are removed from the mold. Once the air and condensate have been removed from the mold, the steam pressure is built up to a predetermined value, such as about 15 psig. The steam is then shut off and the molding block allowed to cool until the pressure drops to about 0 psig. The block so formed can then be removed from the mold. However, the center of the finished block is still hot, (approximately 200° F.–230° F.) and the block may contain from about five to fifteen weight percent moisture. Thus, before the molded blocks are cut into the finished block product the molded blocks are stored for several days to allow time for cooling and drying. Once cooled and dried, the molded blocks can be cut into the desired finished block products. Scraps of material resulting from the cutting of the molded blocks, when subjected to a working force, such as the action of a hammer mill, produce the reclaimed polystyrene beads for use in the practice of the present invention.

The weight of the building panels 10 can be varied by altering the proportions of the design mix. The heavier the panel, the greater load bearing strength it will have, but the increased density of its material reduces the thermal insulating value of the panel and makes the panel more difficult to handle during erection. Conversely, the lighter the panel, the less load bearing strength the panel will have, but the thermal insulating value of the building panel increases and it also is easier to handle during erection.

A good design mix for a building panel to be used in one story wall construction has been found to be as follows. The dimensions of the building panel has been arbitrarily established as being 8 feet long, 32.25 inches wide and 8 inches thick. To make such a building panel having an uncured weight of 317 pounds, the following constituents are mixed: 95 pounds of sand, 55 pounds of water; 141 pounds of Portland cement; 14 cubic feet of reclaimed polystyrene beads; and 12 pounds of masonry cement. While the size of the reclaimed polystyrene beads is not believed to be controlling, it has been determined that the reclaimed polystyrene beads have a larger diameter than the virgin polystyrene beads; and, as previously stated and is readily apparent from FIGS. 6 and 7, the reclaimed polystyrene beads are generally about a quarter inch across, and a cubic foot of the reclaimed polystyrene beads will weigh about one pound. These ingredients are placed in a paddle type mortar mixer and thoroughly mixed. A suggested sequence of adding these ingredients to the mixer is to add the water first, followed by adding the Portland cement, and then add the sand. The last ingredient added is the reclaimed polystyrene beads. It will be noted that, contrasted with the patented methods mentioned hereinabove, the compressible aggregate, e.g. the reclaimed polystyrene beads, is the last ingredient added, yet a homogeneous mixture is achieved.

Following the preparation of the above described mix, a portion of the mix is placed in the cavity 44 of the mold 30 before the tubes 52 are inserted to extend through the cavity. This assures that the cavity space below the tubes will be completely filled. Reinforcing rods can now be placed in between and below the pipe positions if desired. The drawings indicate the selection of five of the bores 18 extending through the building panel 10, so five axially aligned sets of apertures 50 have been disposed in the first and second ends 36, 38 of the mold 30. Five plastic pipes of approximately 4.5 inches in diameter are next placed to extend through the holes 50 so as to extend through the cavity 44; preferably, the diameters of the apertures 50 are determined to permit the free passage of the pipes 50 with a small amount of clearance. Additional mixture is added into the cavity 44 to cover the plastic pipes 50, and additional reinforcing rods are added if desired.

After the mold cavity has been filled with the concrete mix, and the top panel 42 has been positioned on the mold 30, the concrete mixture containing the reclaimed polystyrene beads is compressed by a substantial amount during the setting up of the mixture. That is, after the concrete mixture is added to the cavity 44, the top panel 42 is placed onto the mold 30 and pressure is applied to the top panel 42 in order to compress the mixture in the cavity 44. Since the concrete mixture taken from the mortar mixer is very viscous, the mixture can be heaped up to occupy more volume than the volume of the mold cavity 44. Once the top panel 42 is positioned over the mix, pressure as indicated by the several arrows 60 is created on the top panel 42 to decrease the volume of the mixture in the cavity 44. Various means to achieve this pressure to reduce the volume of the mix in the cavity 44 may be utilized, such as conventional clamping devices (not shown).

In practice it has been found that a hand held float is best used to pack the mixture into the cavity 44 while filling same. The mold cavity is overfilled so that the mixture will crown up about an inch above the sides of the mold. The top panel 42 is then placed on top of the crowned up portion of the mixture material in the cavity 44, and pressed down tightly by the clamps or by other means utilized to create the pressure on the top panel 42. If reinforced plywood material is used to make the mold 30, it has been found that the plywood material will give somewhat as the pressure is applied to the top panel 42; to overcome this, it has been learned that several sharp blows with a heavy blunt instrument such as a large rubber mallet or small sledgehammer on the top panel 42 causes a settling effect to occur, and the curvature of the top panel 42 will be eliminated.

The plastic pipes 52 are selected to be longer than the mold so as to protrude beyond the mold 30 by approximately one foot on each end. These tubes are rotated back and forth about their own axis several times for about 30 minutes after the panel has been cast. This keeps the material from sticking to the pipes. After about 30 minutes, the tubular members 52 can be removed from the mold 30 by pulling on the ends thereof until they are clear of the mold. At this point, the material in the mold 30 will have hardened to the point that the material does not collapse into the voids left after the tubular members have been removed.

After the tubular members 52 have been removed, the concrete mixture in the cavity 44 can simply be left in the mold to harden for about 18 hours, and then removed from the mold and allowed to cure under ambient weather conditions. Alternatively, steam can be introduced into the hollow bores 18 while the concrete mixture is setting. This accelerates the curing process and allows the material to be removed from the mold sooner. Also, high early cement can be used in lieu of Portland cement to accelerate the setting time in order to shorten the time required for the material to be in the mold 30.

It should be noted that although, in the example discussed above, 14 cubic feet of reclaimed polystyrene beads are called for in the mix, the finished panels occupy only 12 cubic feet of space. The reason for this is that the material is forced into the mold under pressure, or squeezed to compact the material into a more dense finished product, without adding weight. The amount of volume reduction in the mold 30 is proportional to the pressure applied. It has been determined that building panels of superior quality and strength have been achieved with a volume reduction of approximately fifteen percent. That is, the volume of the building panel 10 is approximately eighty-five percent of the volume that the concrete material occupies in the mortar mixer before adding to the mold cavity 44.

As mentioned above, the weight of the building panels 10 can be varied by altering the constituents in the concrete mixture. Examples of other mixtures that have been achieved are as follows. For a building panel weighing approximately 303 pounds: 93 pounds of sand; 60 pounds of water; 146 pounds of Portland cement; and 14 cubic feet of reclaimed polystyrene beads. For a building panel weighing 200 pounds: 60 pounds of water; 114.8 pounds of Portland cement; 14 cubic feet of reclaimed polystyrene beads; and 25.2 pounds of flash (fly ash material). While these examples are provided for the purposes of this disclosure, the present invention is not to be considered limited to the examples provided.

An important consideration in preparing the concrete mixture of the present invention is the amount of water introduced while making the mixture. That is, it is important that only enough water is added so that when the formed concrete is compressed in the mold 30, a minimum amount of water is caused to exude from the mold by the application of the pressure. If too much water is introduced into the mixture so that "bleeding" occurs during compression of the mixture, it is believed that the exuded water carries suspended cement with it, leaving a portion of the reclaimed polystyrene beads located at the outer edge of the form baren of cement bonding or coating.

In the method of the present invention, it is preferred that a minimum amount of water be employed in the cementitious mixture to insure complete hydration. Upon setting, the reclaimed polystyrene beads, which are in a compressed condition, expand and prevent the shrinking which could result from hydration. Since the reclaimed polystyrene beads will absorb water under certain conditions, and because the absorbed water will gradually dissipate from the compressed reclaimed polystyrene beads into the surrounding matrix, the crystallization time of the cementitious mixture may be prolonged. The longer the crystallization period, the harder the final cured material will be. It is known that the crystallization is further prolonged by the use of steam curing, the heat from the steam accelerating setting of the material but the moisture from the steam prolonging the total amount of time that crystallization is occurring, with the end result being a product which has crystallized to a harder state than would have been obtained if the absorbed water had been allowed to dissipate in its normal manner.

It is believed that by applying mechanically applied pressure during the setting time of the lightweight cementitious material made from the method of the present invention, greater compressive and tensile strength can be achieved than has been possible from the prior art methods. This increased strength is accomplished primarily by the application of pressure on the lightweight cementitious mixture while the mixture is still in its plastic phase. Of course, this pressure can be applied by mechanical, air or hydraulic methods, and the pressure should be applied as long as the cementitious material remains in the mold. While the mechanism of the present invention is not fully understood, it is believed that the unique properties of the reclaimed polystyrene beads, in conbination with the application of pressure, or squeezing, on the cementitious mixture allow the reclaimed polystyrene beads to be compressed while the cementitious matrix surrounding the compressed reclaimed polystyrene beads hardens and the reclaimed polystyrene beads are bonded to the cementitious matrix. Once the cementitious material has hardened sufficiently that the forms can be removed without deformation of the finished product, the compressible aggregate, i.e. the reclaimed polystyrene beads, remains in a compressive state compressible because the aggregate is constantly attempting to expand against the solid cementitious material encasement. These forces result in a lightweight cementitious product that is as strong as or stronger than similar products produced by the known prior art methods.

It has been determined that more durable service can be expected from the building panels of the present invention if the exterior surfaces of the panels are provided with a coating of plaster which is reinforced with glass fibers. That is, an application of a plaster coating of approximately one eighth inch thick containing glass fibers, such as chopped Fiberglass, on the exterior surfaces of the building panels provides the panels with resistance to surface cracking and checking. (Fiberglass is a trademark of the Owens-Corning Fiberglass Corporation of Toledo, Ohio, for a polymeric mass containing glass fibers or glass flakes.) For this purpose, the following formula has been found to be an exceptionally good surface coating.

The recommended plaster is made by placing 20 pounds of Portand cement in an appropriately sized container; adding 5 pounds of masonry cement; adding 25 pounds of masonry sand; and adding 9.75 pounds of water (color may be placed in the water as is known in conventional art for coloring the plaster). This material is adequately mixed using a small electric drill equipped with a conventional plaster mixer for approximately 30 seconds to one minute. After scraping the sides of the container with a tool, the mixture should be remixed for an additional 30 seconds to one minute. While the mixer is still turning, approximately 1.25 to 1.5 pounds of one quarter inch chopped Fiberglass strands are mixed with the mixture in the container until a homogeneous consistency is achieved. Excessive mixing can physically damage the chopped Fiberglass; accordingly usually five to ten seconds is sufficient using a one-half inch electric drill at 1,200 RPM and a conventional mud mixer.

Once the plaster material has been mixed as has been described, the plaster can be sprayed onto the surface of the building panel 10 by a conventional air gun and compresser machine, or the plaster can be hand applied using a trowel and hawk, as is known conventionally. If the hand method is utilized, care should be taken not to bunch or dislocate the Fiberglass fibers in the spreading and troweling operation.

Figure 4:
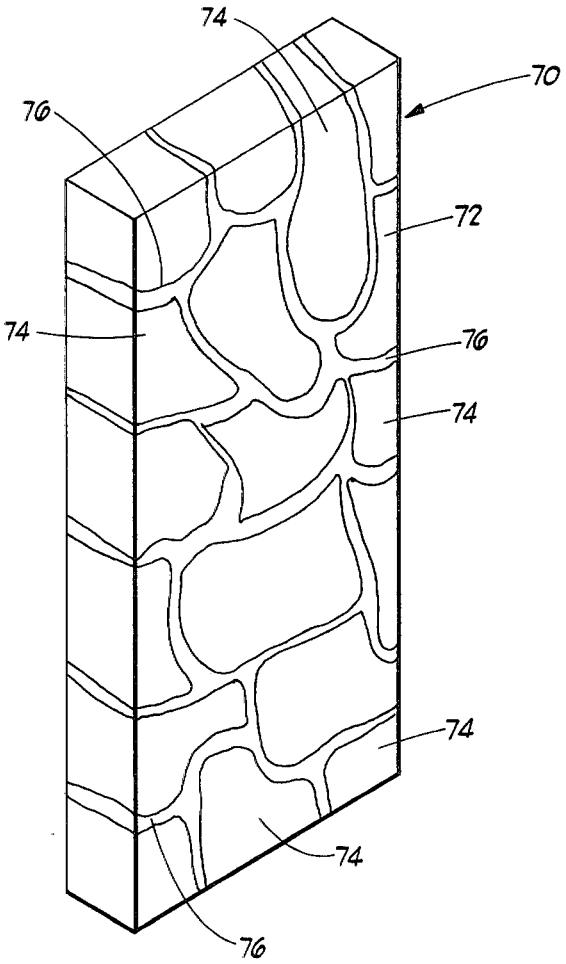
FIG. 4 is a view of a building block constructed of the lightweight material of the present invention and formed by the method herein presented.

The building panel 10 described above is but one of many building products that can be made utilizing the lightweight cementitious product taught herein. In FIG. 4, a building panel 7 is shown that has a front surface 72 formed in the outline of, and having the texture of, stones held together by mortar joints. That is, the surface 72 appears to have several stone areas 74 with relief areas 76 therebetween that have an appearance of being mortar joints.

The building panel 70 is made in a mold (not shown) following the method described above for manufacturing the building panel 10, with the exception that the bottom of the mold is made to have a configuration of irregular topology so as to form the irregular surface 72 as shown, or similar to, that which is depicted in FIG. 4. The relief areas 76 can be painted to have a mortar color, if desired, and the cementitious mix can be colored by conventional means to form a desired stone color.

The building panel 70 of FIG. 4 can be given a more durable exterior surface of Fiberglass material or the like in the following manner. Using the same plaster formula described above (or an equivalent such formula), a layer of the plaster is sprayed onto the interior surfaces of the mold that is used to make the building panel 70, especially on the bottom of the mold that is to form the surface 72 which is the facade of the building panel 70. After this has been accomplished, the lightweight cementitious material, along with any reinforcing that may be desired, is placed into the mold, and the cementitious material containing the compressible aggregate, i.e. the cementitious reclaimed polystyrene beads, is compressed in the manner described above. After compression has been achieved, the mold is inverted so that the surface 72 is at the top of the material in the mold. Although the exact reason for this requirement is not known, it has been determined that this inversion causes the plaster skin to bond more securely to the cementitious mix. If the mold is not inverted before curing, the plaster will not properly bond to the cementitious material in the mold. The details of the mold are not shown in the drawings, since the details of the mold 30 have been described; however, it is a simple matter to invert such a mold by placing the mold on a pivoting fixture or the like.

While an artificial stone facade is shown in the example provided by the building panel 70 of FIG. 4, any other type of a facade such as wood, tile, brick, or other desired facade can be achieved by the method described. Also, the facade shown in FIG. 4 can be incorporated into the building panel 10 by altering the bottom 40 of the mold 30, the result being that a facade surface like the surface 72 shown in FIG. 4 would be achieved on the exterior surface of the building panel 10 of FIG. 1.

Figure 5:
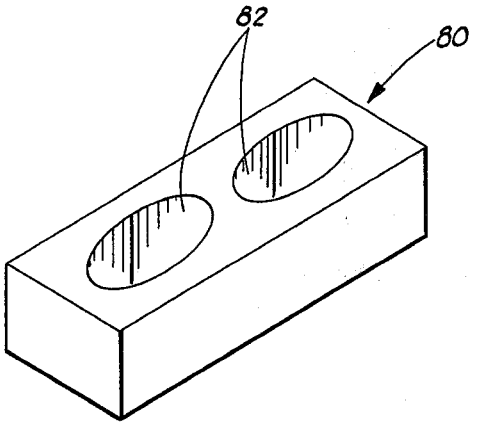
FIG. 5 is a view of yet another building panel constructed of the lightweight material of the present invention and formed by the method herein presented.

The present invention lends itself well to the use of prestressed beam construction. Prestressed beams that have prestressed steel cables on a framework of reinforcing bars may be positioned within the cavity of a mold, and the mold cavity filled as described above with the lightweight cementitious material of the present invention. Also, the lightweight cementitious material of the present invention is very suitable for making lightweight cementitious building blocks of conventional configuration. That is, a building block such as shown in FIG. 5, which is a conventionally designed block 80 having a plurality of voids or bores 82 extending therethrough. While cementitious building blocks (i.e. concrete building blocks) made by the present invention are similar in size and design configuration to the heavier concrete building blocks conventionally found in the building trades, the building blocks made from the present invention weigh far less, resulting in a savings of labor costs during installation. Additionally, the building blocks provide good thermal insulation and will withstand more heat from a fire without cracking or buckling than an ordinary heavy concrete block. While the constituency of the material used to make the lightweight concrete building blocks may vary considerably, a lightweight concrete block of good quality can be made from a batch of material containing 16 pounds of sand, 29 pounds of water, 18 pounds of Portland cement, and 1 cubic foot of reclaimed polystyrene beads. The details of the mold utilized to make the concrete block 80 need not be described herein; it is sufficient to simply note that the concrete mixture is caused to be compressed in the manner described above during the concrete setting period.

By way of further illustrating the light weight cementitious products of the present invention, and method for making same (as well as to illustrate the unique and unexpected properties obtained in such products when employing reclaimed polystyrene beads as hereinbefore described), the following example is given. It is to be understood that the example is for illustrative purposes only and that the example is not to be construed as limiting the scope of the present invention as set forth in the appended claims.

EXAMPLE

Preparation of the concrete matrix:

A batch of concrete matrix material was made up using the following ingredients:

94 pounds of Portland cement 55 pounds of sand 27.5 pounds of water

The above ingredients were placed in a paddle mixer in the following sequence. The water was added first, followed by the addition of the cement, and then the addition of the sand. The paddle mixer was activated prior to the addition of the water and the mixing was continued for approximately ten (10) minutes after the addition of the sand. The cement so made was then transferred to a wheelbarrow for use in making a series of test panels as set forth hereinafter.

Preparation and Identity of Compressible Aggregate Employed in Combination with the Cement to Produce Test Panels.

Compressible Aggregate No. 1.

A block of styrofoam that had been fabricated using modified (fire-resistant) virgin polystyrene beads(1) was cut into approximately one-half (½) inch sheets. The sheets of the polystyrene block were then broken by hand into a number of pieces, fed into a hammermill, and subjected to the additional breaking action of the hammermill. The particles recovered from the hammermill, i.e. the reclaimed polystyrene beads, were substantially spherical in configuration and were determined, by visual observation, to be substantially larger in size than the original virgin beads employed in fabricating the styrofoam block. Further, the reclaimed polystyrene beads were more resilient than the virgin polystyrene beads.

(1) Modified (fire-resistant) virgin polystyrene beads are polystyrene beads sold under the trademark DYLITE by ARCO/Polymers, Inc., a subsidiary of Atlantic Richfield Company. The DYLITE virgin beads have a bulk density of 38 to 40 pounds per cubit foot (pcf) and are freely expanded (preexpanded) to a desired end-product density, usually from 1.0 to 4.5 pounds per cubic foot (pcf).

Compressible Aggregate No. 2

A block of styrofoam that had been fabricated using unmodified (non-fire resistant) virgin polystyrene beads(2) was cut into approximately one-half (½) inch sheets. The sheets of the polystyrene block were then broken by hand into a number of pieces, fed into a hammermill, and subjected to the additional breaking action of the hammermill. The particles recovered from the hammermill, i.e. the reclaimed polystyrene beads, were substantially spherical in configuration and were determined, by visual observation, to be substantially larger in size than the original virgin beads employed in fabricating the styrofoam block. Further, the reclaimed polystyrene beads were more resilient than the virgin polystyrene beads.

(2) Unmodified (non-fire resistent) virgin polystyrene beads are polystyrene beads sold under the trademark DYLITE by ARCO/Polymers, Inc., a subsidiary of Atlantic Richfield Company. The DYLITE virgin beads have a bulk density of 38 to 40 pounds per cubic foot (pcf) and are freely expanded (preexpanded) to a desired end-product density, usually from 1.0 to 4.5 pounds per cubic foot (pcf).

Compressible Aggregate No. 3

Modified (fire-resistant) virgin polystyrene beads(1) were obtained for use as the compressible aggregate in the production of a cementitious product. The modified virgin polystyrene beads had been cured for fourteen hours prior to receipt of same at the plant site where the virgin polystyrene beads were produced. The virgin polystyrene beads were not subjected to any further treatment, other than curing, prior to their incorporation into the cement for fabricating of a test panel.

(1) Modified (fire-resistant) virgin polystyrene beads are polystyrene beads sold under the trademark DYLITE by ARCO/Polymers, Inc., a subsidiary of Atlantic Richfield Company. The DYLITE virgin beads have a bulk density of 38 to 40 pounds per cubic foot (pcf) and are freely expanded (preexpanded) to a desired end-product density, usually from 1.0 to 4.5 pounds per cubic foot (pcf).

Preparation and Description of Mold for Forming Test Panels.

A mold was fabricated from wood. The mold was constructed and dimensioned as follows:

Two 2" by 2" strips of wood were secured to a sheet of plywood such that the two strips of wood were spaced in a parallel relationship twenty six and one-half (26½) inches apart. Three compartments were then formed by securing wood dividers between the two parallel side strips. Each of the compartments had the following dimensions: 26½"×16"×2". A second sheet of plywood was employed as the top portion of the mold, the top portion being securely position on the lower portion of the mold after the cementitious compositions as described hereinafter were placed in the mold.

Formation of Composition No. 1 for Test Panel No. 1

Twenty-two (22) pounds of the concrete matrix material prepared as described above were removed from the wheelbarrow and placed in a paddle mixer. While the concrete matrix material was agitated one (1) cubic foot of the compressible aggregate No. 1 was added to the concrete matrix material in the paddle mixer as set forth above. The Compressible Aggregate No. 1 is the reclaimed polystyrene beads from the block of styrofoam produced using modified virgin polystyrene beads, typical reclaimed polystyrene beads being depicted in FIG. 7. The concrete matrix material and the resulting composition was placed in one of the before described compartments of the mold.

Formation of Composition No. 2 for Test Panel No. 2

Twenty-two (22) pounds of the concrete matrix material prepared as described above were removed from the wheelbarrow and placed in a paddle mixer. While the concrete matrix mix was agitated one (1) cubic foot of the compressible aggregate No. 2 was added to the concrete matrix material in the paddle mixer. As hereinbefore set forth, the compressible aggregate No. 2 is the reclaimed polystyrene beads from the block of styrofoam produced by using unmodified virgin polystyrene beads (i.e. the compressible aggregate No. 2). The concrete matrix material and the compressible aggregate No. 2 were mixed in the paddle mixer for three (3) minutes and the resulting composition was placed in one of the before described compartments of the mold.

Formation of Composition No. 3 for Test Panel No. 3

Twenty-two (22) pounds of the concrete matrix material prepared as described above were removed from the wheelbarrow and placed in a paddle mixer. While the concrete matrix mix was agitated one (1) cubic foot of the compressible aggregate No. 3 was added to the concrete matrix material in the paddle mixer. As hereinbefore set forth, the compressible aggregate No. 3 is the modified (fire-resistant) virgin polystyrene beads, and such virgin polystyrene beads being depicted in FIG. 6.

The concrete matrix material and the compressible aggregate No. 3 were mixed in the paddle mixer for three (3) minutes and the resulting composition was placed in one of the before described compartments of the mold.

Formation of Test Panels

Once the three resulting compositions, i.e. Composition Nos. 1, 2 and 3, had been placed in separate compartments of the mold, a plywood top was placed over the mold and the compositions in the mold were compressed. Compression was maintained on the composition Nos. 1, 2 and 3 in the mold until the compositions had set. At the end of a twenty-four (24) hour setting period the resulting test panels (i.e., test panels Nos. 1, 2 and 3) were removed from the mold, marked for identification, and placed together in one plastic bag. The plastic bag was then sealed and the test panels were maintained in the sealed plastic bag for four (4) days. At the end of the four (4) day period the test panels were removed from the sealed plastic bag and subjected to a series of test procedures. The test procedures and the results of same are set forth as follows.

Test Procedures and Results

Each of the test panels were positioned across two 2"×2" strips of wood. The strips of wood were disposed so that the wood strips supported the opposite ends of the test panels such that test panels were in a flat position. A container was then substantially centrally positioned on the test panels and weight was added to the container until the panel collapsed.

The test panel No. 1, the panel containing the compressible aggregate No. 1 (i.e. the reclaimed polystyrene beads obtained from the block of styrofoam formed of modified virgin polystyrene beads) broke when ninety-eight (98) pounds of weight was applied.

The test panel No. 2, the panel containing the compressible aggregate No. 2 (i.e. the reclaimed polystyrene beads obtained from the block of styrofoam formed of unmodified virgin polystyrene beads) broke when one hundred nineteen (119) pounds of weight was applied.

The test panel No. 3, the panel containing the compressible aggregate No. 3 (i.e. the modified virgin polystyrene beads), broke when twenty (20) pounds of weight was applied.

Strips were then cut from each of the above test panels Nos. 1, 2 and 3, each of the strips having dimensions of $1\frac{1}{2}''\times1\frac{1}{2}''\times16''$. A strip from each of the test panels Nos. 1, 2 and 3 was then subjected to a drop test to determine the ability of the test panel to withstand the force generated by the drop test. Each strip was positioned a distance of thirty-six (36) inches from a concrete floor and dropped so that the panels were flat when striking the floor. The test panels No. 1 and No. 2, (i.e. the test panels containing as the compressible aggregate the reclaimed polystyrene beads) showed no breakage. However, the test panel No. 3 (i.e. the test panel containing as the compressible aggregate the modified virgin polystyrene beads) broke into four (4) pieces.

A center strip portion from each of the test panels Nos. 1, 2 and 3 was cut to provide $1\frac{5}{8}''$ test cubes. The compressible aggregate, which was substantially evenly dispersed throughout each of the test cubes was examined to determine the bonding characteristics of the compressible aggregates Nos. 1, 2 and 3 with the cement matrix used on the construction of the test panels.

Upon examination of the test cubes it was determined that by taking a sharp pointed object the virgin polystyrene beads (i.e. the compressible aggregate No. 3) could readily be removed from the test cubes cut from the test panel No. 3 leaving a clean cavity. Thus, the virgin polystyrene bead did not bond to the cement. On the other hand, the reclaimed polystyrene beads (i.e. the compressible aggregate Nos. 1 and 2 could not be removed from the test cubes cut from the test panels Nos. 1 and 2, with the sharp pointed object without tearing the compressible aggregate apart and leaving a portion of the aggregate in the cavity. Thus, it was readily determined that the reclaimed polystyrene beads, even though of substantially spherical configuration, readily bonded to the cement matrix.

The data set forth above clearly indicates the improved and unexpected properties achievable in lightweight cementitious products which consists essentially of a cementitious matrix and a compressible aggregate having the properties and characteristics of the reclaimed polystyrene aggregate as hereinbefore described.

It is clear that the present invention is well adapted to carry out the objects and attain the ends and advantages mentioned as well as those inherent therein. While certain novel features of the invention have been shown and described and are pointed out in the appended claims, it will be understood that various omissions, substitutions and changes in the forms and details of the invention illustrated and in its operation can be made by those skilled in the art without departing from the spirit of the invention.

What is claimed is:

1. A method for preparing a lightweight cementitious product comprising the steps of:

heating virgin polystyrene beads until the beads fuse together to form molded polystyrene material;

cooling and drying the molded polystyrene material;

subjecting the molded polystyrene material to a fracturing force so as to form a polystyrene particle mixture consisting essentially of reclaimed polystyrene beads having a compact, substantially curved surface which is interrupted by at least one discontinuously projecting section, the reclaimed polystyrene beads having an average radius of curvature exceeding the average radius of curvature of the virgin polystyrene beads;

forming an aqueous cementitious mixture, dispersing an effective amount of polystyrene particle mixture into the aqueous cementitious mixture to form a resulting cementitious mixture;

placing the resulting cementitious mixture in a mold having a cavity of a desired configuration;

compressing the resulting cementitious mixture in the mold to reduce the volume of the resulting cementitious mixture an effective amount while minimizing the amount of water exuding from the resulting cementitious mixture; and maintaining the resulting cementitious mixture in a compressed state for a period of time effective to allow the resulting cementitious mixture to set in the compressed state and form the lightweight cementitious product.

2. The product produced by the method of claim 1.

3. The method of claim 1 wherein the reclaimed polystyrene beads are further characterized as having a substantially spherical configuration.

4. The method of claim 3 which further comprises heating the compressed resulting cementitious material in the mold during the step of compressing the resulting cementitious material therein.

5. The method of claim 3 wherein the effective amount of the reclaimed polystyrene beads dispersed into the aqueous cementitious mixture is characterized as the amount necessary to enable the volume of the resulting cementitious mixture to be reduced by approximately fifteen percent upon compressing the resulting cementitious mixture in the mold.

6. The method of claim 5 which further comprises heating the compressed resulting cementitious mixture in the mold during the step of compressing the resulting cementitious mixture therein.

7. The method of claim 1 which further comprises:

disposing a plurality of tubular members in the mold such that the tubular members extend through the mold, the tubular members being disposed therein prior to placing the resulting cementitious mixture into the mold; and removing the plurality of tubular members from the mold prior to a final setting of the resulting cementitious mixture to provide a lightweight cementitious product having a plurality of hollow conduit shaped bores extending therethrough.

8. The lightweight cementitious product prepared by the method of claim 7.

9. The method of claim 5 which further comprises:

disposing a plurality of tubular members in the mold such that the tubular members extend through the mold, the tubular members being disposed therein prior to placing the resulting cementitious mixture into the mold; and removing the plurality of tubular members from the mold prior to a final setting of the resulting cementitious mixture to provide a lightweight cementitious product having a plurality of hollow conduit shaped bores extending therethrough.

10. The lightweight cementitious product prepared by the method of claim 9.

11. The method of claim 1 wherein the cementitious constituent is a hydraulic cement.

12. The method of claim 11 wherein the hydraulic cement is Portland cement.

13. The lightweight cementitious product prepared by the method of claim 12.

14. The method of claim 12 wherein the hydraulic cement comprises a mixture of Portland cement and masonry cement.

15. The lightweight cementitious product prepared by the method of claim 14.

16. The method of claim 5 wherein the cementitious constituent is a hydraulic cement.

17. The method of claim 16 wherein the hydraulic cement is Portland cement.

18. The lightweight cementitious product prepared by the method of claim 17.

19. The method of claim 17 wherein the hydraulic cement comprises a mixture of Portland cement and masonry cement.

20. The lightweight cementitious product prepared by the method of claim 19.

21. The method of claim 1 which further comprises the step of positioning a portion of a prestressed cable assembly in the cavity of the mold prior to placing the resulting cementitious mixture therein such that upon placing the resulting cementitious mixture in the mold the cementitious mixture surrounds a portion of the prestressed cable assembly disposed within the mold.

22. The lightweight cementitious material prepared by the method of claim 21.

23. The method of claim 5 which further comprises the step of positioning a portion of a prestressed cable assembly in the cavity of the mold prior to placing the resulting cementitious mixture therein such that upon placing the resulting cementitious mixture in the mold the cementitious mixture surrounds a portion of the prestressed cable assembly disposed within the mold.

24. The lightweight cementitious product prepared by the method of claim 23.

25. The method of claim 1 which further comprises:

removing the cementitious product from the mold; and applying plaster to selected surfaces of the cementitious product, the plaster comprising approximately 34 weight percent Portland cement, approximately 8 weight percent masonry cement, approximately 42 weight percent sand and approximately 16 weight percent water.

26. The lightweight cementitious product prepared by the method of claim 25.

27. The method of claim 25 wherein approximately 2.5 weight percent glass fiber strands are blended into the plaster.

28. The lightweight cementitious product prepared by the method of claim 27.

29. The method of claim 5 which further comprises:

removing the cementitious product from the mold; and applying plaster to selected surfaces of the cementitious product, the plaster comprising approximately 34 weight percent Portland cement, approximately 8 weight percent masonry cement, approximately 42 weight percent sand and approximately 16 weight percent water.

30. The lightweight cementitious product prepared by the method of claim 29.

31. The method of claim 29 wherein approximately 2.5 weight percent glass fiber strands are blended into the plaster.

32. The lightweight cement product prepared by the method of claim 31.

33. The method of claim 1 which comprises:

applying plaster to a selected inside surface of the mold prior to placing the resulting cementitious mixture into the mold, the plaster comprising approximately 34 weight percent Portland cement, approximately 8 weight percent masonry cement, approximately 42 weight percent sand, and approximately 16 weight percent water; and inverting the mold after compressing the resulting cementitious mixture to reduce the volume of the resulting cementitious mixture.

34. The lightweight cementitious product prepared by the method of claim 33.

35. The method of claim 33 wherein approximately 15 weight percent glass fiber strands are blended into the plaster.

36. The lightweight cementitious product prepared by the method of claim 35.

37. The method of claim 5 which comprises:

applying plaster to a selected inside surface of the mold prior to placing the resulting cementitious mixture into the mold, the plaster comprising approximately 34 weight percent Portland cement, approximately 8 weight percent masonry cement, approximately 42 weight percent sand, and approximately 16 weight percent water; and inverting the mold after compressing the resulting cementitious mixture to reduce the volume of the resulting cementitious mixture.

38. The lightweight cementitious product prepared by the method of claim 37.

39. The method of claim 37 which comprises:

applying plaster to a selected inside surface of the mold prior to placing the resulting cementitious mixture into the mold, the plaster comprising approximately 34 weight percent Portland cement, approximately 8 weight percent masonry cement, approximately 42 weight percent sand, and approximately 16 weight percent water; and inverting the mold after compressing the resulting cementitious mixture to reduce the volume of the resulting cementitious mixture.

40. The method of claim 37 wherein approximately 15 weight percent glass fiber strands are blended into the plaster.

41. The lightweight cementitious product prepared by the method of claim 39.

* * * * *

UNITED STATES PATENT AND TRADEMARK OFFICE

CERTIFICATE OF CORRECTION

PATENT NO. : 4,306,395

DATED : December 22, 1981

INVENTOR(S) : Orval R. Carpenter

It is certified that error appears in the above-identified patent and that said Letters Patent are hereby corrected as shown below:

In column 2, line 34 after the word "cementitious" insert the word --product--.

In column 2, line 41, strike the words "maintaining comprising on the resulting admixture".

Signed and Sealed this

*First* Day of *June 1982*

[SEAL]

*Attest:*

GERALD J. MOSSINGHOFF

*Attesting Officer*

*Commissioner of Patents and Trademarks*